US012691491B2

(12) United States Patent
Gellhaus et al.

(10) Patent No.: US 12,691,491 B2
(45) Date of Patent: Jul. 28, 2026

(54) METHOD FOR ROLLING A RING-SHAPED ROLLING PRODUCT HAVING AN OPEN CYLINDRICAL CROSS SECTION IN A RING ROLLING MACHINE, AND RING ROLLING MACHINE FOR CARRYING OUT THE METHOD

(71) Applicant: SMS group GmbH, Düsseldorf (DE)

(72) Inventors: Martin Gellhaus, Bochum (DE); Jens Riemel, Bochum (DE); Markus Langejürgen, Wipperfürth (DE); Christian Vogt, Wuppertal (DE)

(73) Assignee: SMS group GmbH, Düsseldorf (DE)

( * ) Notice: Subject to any disclaimer, the term of this patent is extended or adjusted under 35 U.S.C. 154(b) by 271 days.

(21) Appl. No.: 18/289,217

(22) PCT Filed: May 2, 2022

(86) PCT No.: PCT/EP2022/061712
§ 371 (c)(1),
(2) Date: Nov. 1, 2023

(87) PCT Pub. No.: WO2022/233787
PCT Pub. Date: Nov. 10, 2022

(65) Prior Publication Data

US 2024/0253105 A1 Aug. 1, 2024

(30) Foreign Application Priority Data

May 3, 2021 (DE) ..... 10 2021 204 433.6

(51) Int. Cl.
*B21H 1/06* (2006.01)

(52) U.S. Cl.
CPC ..... *B21H 1/06* (2013.01)

(58) Field of Classification Search
CPC ... B21H 1/06; B21H 1/08; B21H 1/10; B21H 1/12; B21H 1/02
See application file for complete search history.

(56) References Cited

U.S. PATENT DOCUMENTS

| | | | | |
|---|---|---|---|---|
| 11,076,454 | B2 * | 7/2021 | Verhagen | C21D 1/42 |
| 2012/0279268 | A1 * | 11/2012 | Loveless | B21B 5/00 72/69 |
| 2020/0306817 | A1 | 10/2020 | Murai et al. | |

(Continued)

FOREIGN PATENT DOCUMENTS

| | | | | |
|---|---|---|---|---|
| CN | 109590417 | A | 4/2019 | |
| CN | 109663821 | A * | 4/2019 | B21H 1/06 |
| EP | 3143834 | A1 | 3/2017 | |

(Continued)

*Primary Examiner* — Debra M Sullivan
(74) *Attorney, Agent, or Firm* — Smartpat PLC

(57) ABSTRACT

A method for rolling a ring-shaped rolling product (5) having an open cylindrical cross section in a ring rolling machine (1) with inductive heating of the rolling product (5) during the rolling process uses at least one inductor (12) which is held at a predefined coupling distance relative to the rolling product (5) and is tracked or carried along during the shaping process in accordance with the change in dimensions of the rolling product (5). An alternating magnetic field, preferably with a frequency of between 4 and 10 kHz, is coupled directly into the rolling product (5) using the inductor (12).

8 Claims, 3 Drawing Sheets

(56) References Cited

U.S. PATENT DOCUMENTS

2020/0306818 A1 10/2020 Murai et al.

FOREIGN PATENT DOCUMENTS

| | | | |
|---|---|---|---|
| EP | 3385005 | A1 | 10/2018 |
| EP | 3715001 | A1 | 9/2020 |
| JP | H01237036 | A | 9/1989 |
| WO | 2017094864 | A1 | 6/2017 |

* cited by examiner

METHOD FOR ROLLING A RING-SHAPED ROLLING PRODUCT HAVING AN OPEN CYLINDRICAL CROSS SECTION IN A RING ROLLING MACHINE, AND RING ROLLING MACHINE FOR CARRYING OUT THE METHOD

CROSS-REFERENCE TO RELATED APPLICATION

This application is a national stage application, filed under 35 U.S.C. § 371, of International Patent Application PCT/EP2022/061712, filed on May 2, 2022, which claims the benefit of German Patent Application DE 10 2021 204 433.6, filed on May 3, 2021.

BACKGROUND

The inductive heating of rolling product during the rolling process when rolling a ring-shaped rolling product is generally known, for example from US 2012/0279268 A1. This publication relates to a method for forging a ring-shaped workpiece with simultaneous electrical heating of the workpiece by means of induction. The method comprises partially or completely enclosing the workpiece with a closed or C-shaped magnetizable core, which is wrapped with a coil, to which a low frequency alternating current in the range of approximately 1000 Hz or less is applied. This method is cumbersome and costly, not least because of the necessary enclosure of the workpiece with the magnetic or magnetizable core.

Further prior art is known from CN 109590417 A, CN 109663821 A, and JP 01237036 A.

SUMMARY

The disclosure relates to a method for rolling a ring-shaped rolling product with an open cylindrical cross section in a ring rolling machine with inductive heating of the rolling product during the rolling process.

In particular, the disclosure relates to a method for producing metal rings with rectangular or profiled cross sections from various types of steel, along with special alloys such as titanium and nickel-based alloys, copper alloys and aluminum alloys by rolling.

The disclosure is based on the object of providing a method of the type mentioned at the beginning, with which it is easily possible to compensate for temperature losses of the workpiece during shaping and, in particular, to achieve inductive heating of the rolling product during the rolling process with as little effort as possible.

The temperature control during rolling is intended to counteract heat losses, in particular through radiation. As the size of the rolling product increases, or as the diameter of the ring increases during rolling, as the case may be, the surface area increases, which results in increasing heat losses. Such temperature losses are to be compensated for.

The object is achieved by a method as disclosed herein and by a ring rolling machine as disclosed herein.

According to one aspect, the method comprises the use of at least one inductor, which is held at a predefined and constant coupling distance relative to the rolling product and is tracked or carried along during the shaping process in accordance with the change in dimensions of the rolling product, wherein an alternating magnetic field, preferably with a frequency between 4 and 10 kHz, is directly coupled into the rolling product by the inductor.

An enclosure of the rolling product or partially enclosure of the rolling product with an electrically conductive core is not provided and not required with the method. Instead, at least one inductor is positioned at a relatively small distance from the rolling product and held there during the rolling process. Such distance, which is dimensioned to allow induction of an alternating magnetic field in the rolling product and consequent heating of the rolling product, is referred to in the present application as the coupling distance.

The inductor can be designed to be a flat or C-shaped or L-shaped coil.

The inductor is preferably positioned and held on the outer circumference of the rolling product during the rolling process. The rolling product, in the form of a cylindrical ring open on both sides and preferably with a profiled cross section, undergoes changes in dimensions during the shaping process. The diameter of the ring-shaped rolling product increases, the height of the ring decreases and its width also decreases. Accordingly, the method includes tracking the inductor in accordance with the change in dimensions of the rolling product with a constant coupling distance to the rolling product.

In principle, the inductor can be fastened to a support arm that, for example, can follow the diameter increase of the ring-shaped rolling product with a rolling mill stand for axial rolls of the ring rolling machine. The support arm can be fastened to the rolling mill stand, for example.

Alternatively, it can be provided that the inductor is tracked in a controlled manner by means of at least one manipulator with at least one linear movement and/or one rotary movement on a movement axis. This can be achieved in particular by means of a multi-axis industrial robot, on which at least one inductor can be arranged.

With an expedient variant of the method, it is provided that an actual distance of the inductor to the rolling product is detected by sensors during the rolling process and the coupling distance is automatically controlled as a target distance as a function of the actual distance. Such control can be carried out with a control unit of the ring rolling machine provided for this purpose. Alternatively, the control can be performed with a separate control unit.

Preferably, the detection by sensors of the actual distance of the inductor from the rolling product is carried out in a tactile manner or without contact. In the case of tactile detection of the actual distance, this can be performed by means of at least one sensing roller, which can be fastened directly to the inductor, for example.

With a preferred variant of the method, it is provided that the distance of the inductor from the rolling product is predefined via spacers resting against the rolling product during the rolling process.

Alternatively or additionally, a contactless detection of the actual distance by means of at least one optical sensor can be provided.

With a preferred variant of the method, it is provided that an inductive coupling with at least one inductor takes place in the direction of rotation of the rolling product at least upstream of a main roll or an axial roll arrangement of the ring rolling machine, such the that heating of the rolling product takes place in each case immediately prior to engagement of the main roll or engagement of the axial roll arrangement in the rolling product. The inductor or plurality of inductors can be provided at any point of the ring rolling machine on the circumference of the rolling product.

Furthermore, it can be provided that at least two inductors are positioned at the circumference of the rolling product, for example in the direction of rotation of the rolling product at least upstream of a main roll and upstream of an axial roll arrangement of the ring rolling machine, if this is designed as a radial-axial ring rolling machine.

As mentioned above, it is expedient if the inductor is guided on a support arm, which preferably has at least two degrees of freedom, preferably three degrees of freedom. Preferably, the inductor is guided in both a linearly displaceable and rotatable manner.

It is provided that the inductor is carried along during the rolling process with the increasing radius and with the shifting of the axis of rotation of the cylindrical rolling product.

A further aspect relates to a ring rolling machine, which is preferably designed to carry out the method described above. The ring rolling machine is preferably designed as a radial or radial-axial ring rolling machine and comprises at least one driven main roll and at least one mandrel roll, preferably furthermore at least two axial rolls, preferably as conical rolls, along with means for centering a ring-shaped rolling product. The ring rolling machine is characterized by at least one inductor, which can be positioned at a predefined coupling distance to the rolling product on an outer circumference of the rolling product during the rolling process and can be tracked according to the change in dimensions of the rolling product to maintain a constant coupling distance, wherein an alternating magnetic field, preferably with a frequency between 4 and 10 kHz, can be induced in the rolling product with the inductor. At least one of the axial rolls can be designed as a driven roll.

The ring rolling machine can be designed as a radial ring rolling machine or as a radial-axial ring rolling machine. Only in the latter case would the ring rolling machine include axial rolls.

As means for centering the rolling product, swivel arms with centering rollers can be provided, which rest against the outer circumference of the rolling product during the rolling process.

With a preferred variant of the ring rolling machine, it is provided that the inductor is fastened to a support arm of a manipulator that is movable in at least two degrees of freedom, preferably in three degrees of freedom.

With a further advantageous variant of the ring rolling machine, it is provided that the inductor is arranged at least in front of the main roll or the axial rolls in the direction of rotation of the rolling product.

Alternatively, one inductor each can be arranged in front of the main roll and the axial rolls in the direction of rotation of the rolling product.

More than two inductors can also be provided on the circumference of the rolling product.

The invention is explained below with reference to an exemplary embodiment shown in the drawings.

DETAILED DESCRIPTION

Figure 1:
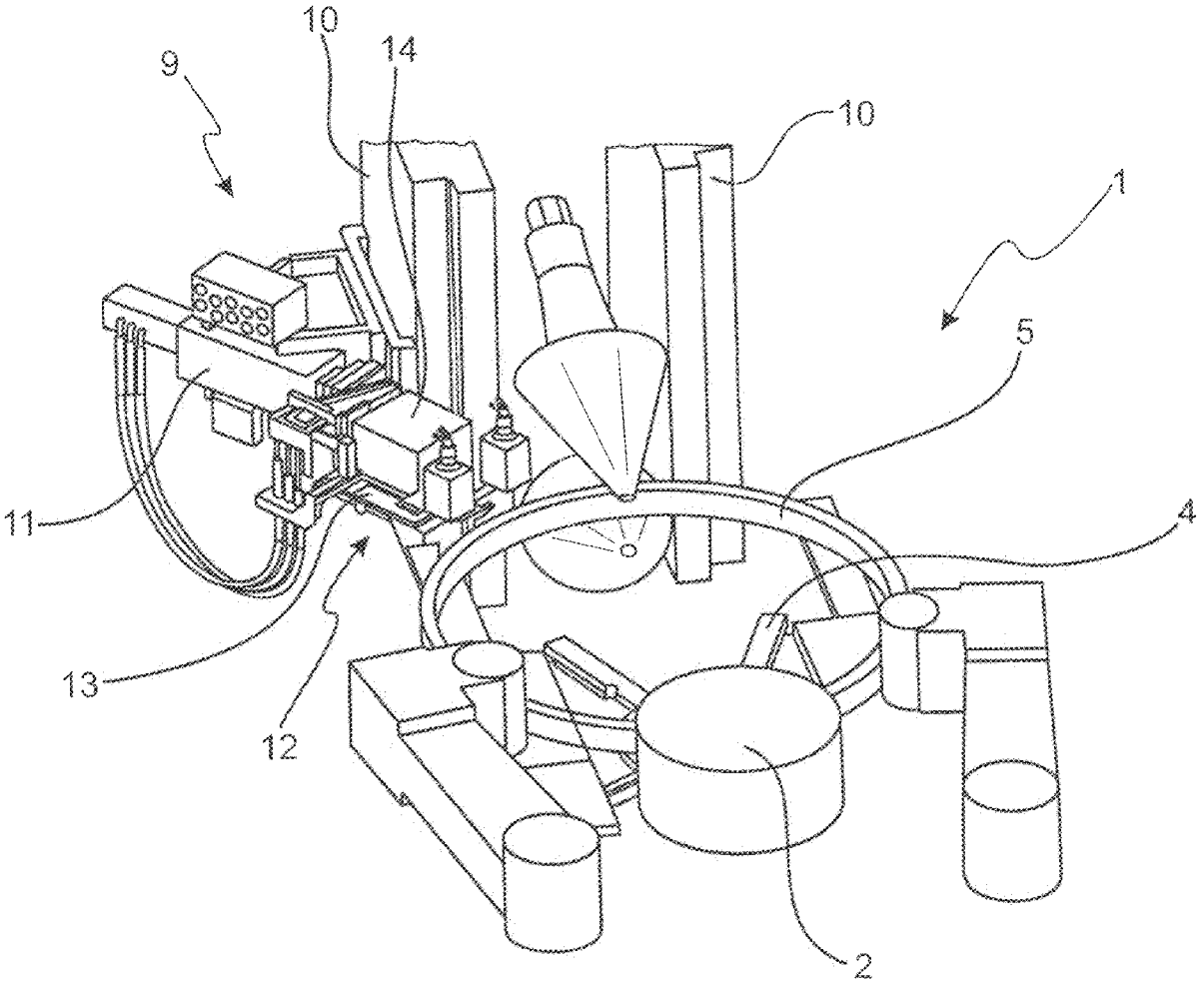
FIG. 1 is a perspective view of a ring rolling machine.

The ring rolling machine 1 shown in the figures comprises a driven main roll 2 along with a roll table 4. The rolling product designated 5 is designed as a closed ring or as a cylinder that is open on both sides, as the case may be. The rolling product 5 has a rectangular cross sectional profile and rests on the roll table 4. The rolling product 5 is rolled between the main roll 2 and the mandrel roll 3 in a clockwise direction, reducing the wall thickness radially and at the same time reducing the height axially. In this case, the rolling product 5 is centered in the ring rolling machine 1 by means of centering rollers 7 fastened to swivel arms 6. Axially, the rolling product 5 is rolled by means of two axial rolls 8. The axial rolls 8 are designed as conical rolls and are mounted in an axial stand 10. The axial stand 10 can be displaced or adjusted, as the case may be, with respect to the center point of the rolling product 5, which shifts during the rolling process as a result of the increase in the radius, namely radially with respect to the rolling product 5.

In the exemplary embodiment described, a support arm 11 is fastened to the axial stand 10, and an inductor 12 is arranged at its distal end, which is directed radially inwards with respect to the rolling product 5. As mentioned above, the inductor 12 can alternatively be fastened to an articulated arm of an industrial robot, which is positioned around the circumference of the ring rolling machine 1.

Figure 3:
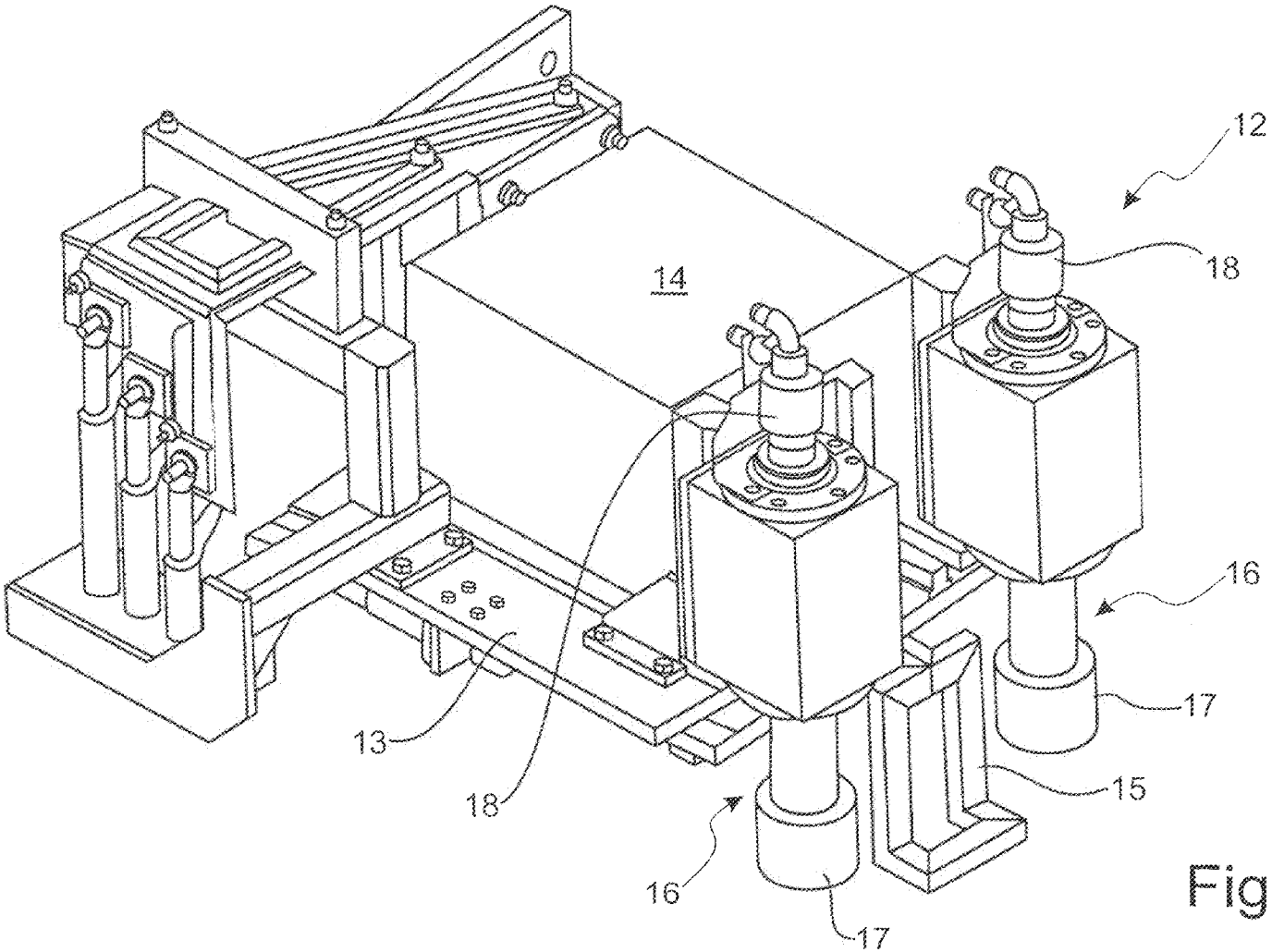
FIG. 3 is a perspective representation of the inductor.

The inductor 12 comprises a transformer unit 14 arranged on a base plate 13 and an induction coil 15, as can be seen in FIG. 3. The transformer unit 14 is connected to a capacitor cabinet, which is not shown, via air-cooled and/or water-cooled cables and provides the electrical matching of the induction voltage to the output voltage of a frequency converter. The frequency converter operates in a frequency range between 4 and 10 kHz. Furthermore, two spacers 16 are arranged on the base plate 13, between which the induction coil 15 is located. The spacers 16 are designed as sensing rollers extending parallel to the axis of rotation of the rolling product 5, the roller heads 17 of which are held in engagement with the rolling product 5 during the rolling process. The spacers 16 are water-cooled. Coolant ports 18 are provided for the aforementioned spacers 16, through which coolant flows The induction coil, the transformer unit and the spacers 16 are arranged on the base plate, so that they can be adjusted both linearly and rotatably. Since, as described above, the radius of the rolling product 5 increases during the rolling process and, as a result, the distance between the induction coil 15 and the rolling product 5 would increase, a further linear adjustment is provided between the spacers 16 and the induction coil 15. Adjustability ensures that the distance between the induction coil 15 and the rolling product can be kept constant.

In order to be able to guide and hold the inductor 12 at a constant close coupling distance to the outer circumference of the rolling product 5 during the entire rolling process, the support arm 11 is furthermore radially displaceable with the axial stand 10 with respect to the rolling product. During the rolling process, the height of the rolling product 5 will decrease on the one hand, and on the other hand the diameter of the rolling product 5 will increase, such that the support arm 11 must be adjusted radially at least with respect to the rolling product 5.

Figure 2:
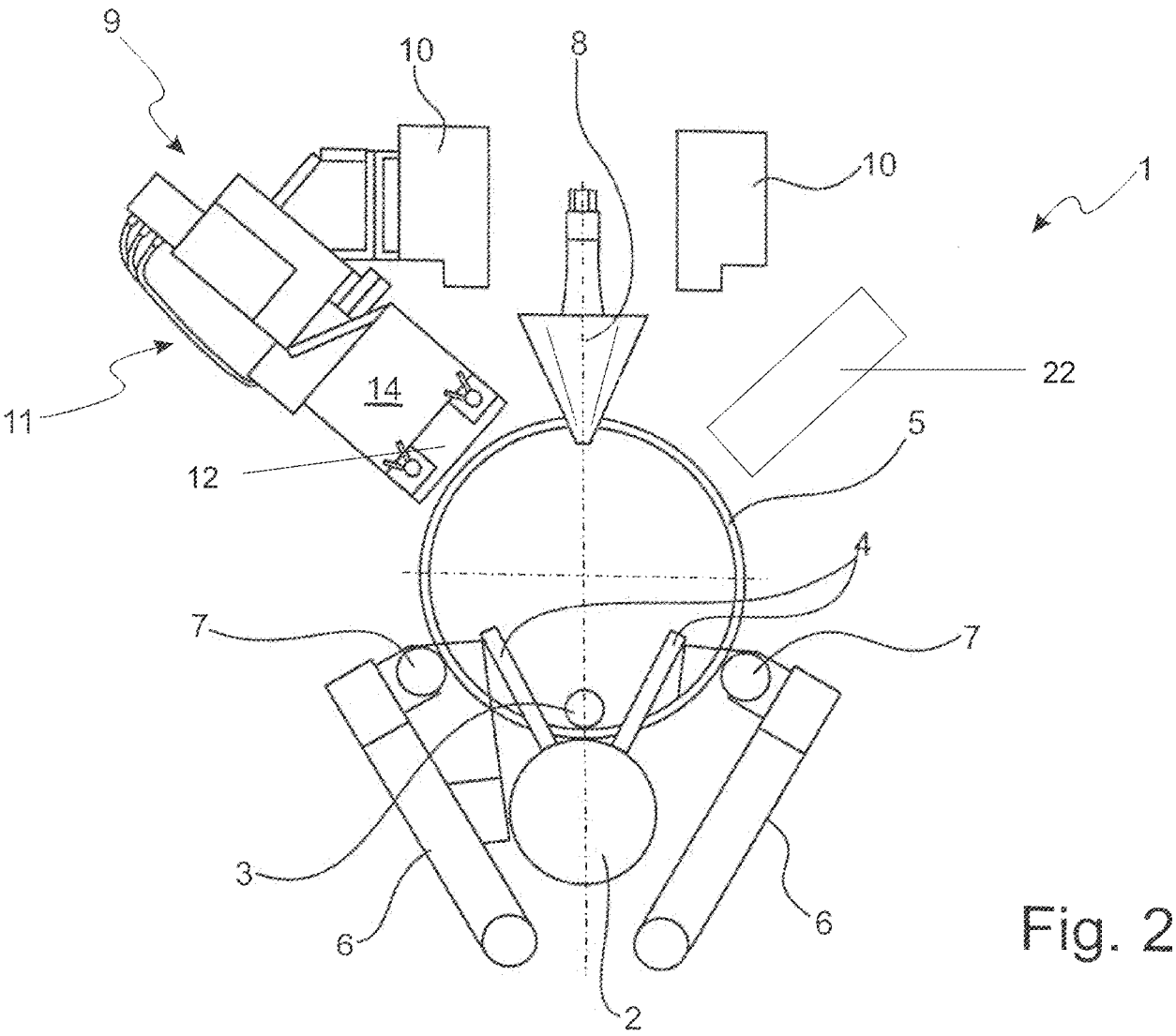
FIG. 2 is a top view of the ring rolling machine.

FIG. 2 shows two inductors are positioned at the circumference of the rolling product. A first inductor 12 is positioned in the direction of rotation of the rolling product upstream of the main roll 2 and a second inductor 22 is positioned upstream of an axial roll arrangement 8 of the ring rolling machine.

The induction coil 15 shown in FIG. 3 has an approximately L-shaped cross sectional profile that extends under a part of the underside of the ring-shaped rolling product 5. The induction coil can also have a different geometry. It is not necessary that the induction coil 15 extends under the underside of the ring-shaped rolling product 5.

LIST OF REFERENCE SIGNS

1 Ring rolling machine
2 Main roll
3 Mandrel roll
4 Roll table
5 Rolling product
6 Swivel arms
7 Centering rollers
8 Axial rolls
9 Manipulator
10 Axial stand
11 Support frame
12 Inductor
13 Base plate
14 Transformer unit
15 Induction coil
16 Spacer
17 Roller heads
18 Coolant ports
22 Second inductor

The invention claimed is:

1. A method for rolling a ring-shaped rolling product (5) having an open cylindrical cross section in a ring rolling machine (1), comprising:

holding an inductor (12) at a predefined coupling distance relative to the rolling product (5);

rolling the rolling product (5);

moving the inductor (12) during the rolling in accordance with a change in dimensions of the rolling product (5);

applying an alternating magnetic field into the rolling product (5) using the inductor (12) and thereby inductively heating the rolling product (5) during the rolling;

detecting an actual distance between the inductor (12) and the rolling product (5) by tactile sensing during the rolling using at least two sensing rollers or at least two spacers (16) that are in engagement with an outer circumference of the rolling product (5); and automatically controlling the coupling distance as a function of the actual distance.

2. The method according to claim 1, wherein the alternating magnetic field has a frequency between 4 and 10 kHz.

3. The method according to claim 1, further comprising:

positioning and holding the inductor (12) on an outer circumference of the rolling product (5) during the rolling process.

4. The method according to claim 1, further comprising:

moving the inductor (12) in a controlled manner by at least one linear movement and one rotary movement on at least one movement axis.

5. The method according to claim 1, wherein applying the alternating magnetic field directly into the rolling product (5) takes place in a direction of rotation of the rolling product (5) in front of a main roll (2) or an axial roll arrangement of the ring rolling machine (1).

6. The method according to claim 1, further comprising:

applying a further alternating magnetic field into the rolling product (5) using a further inductor.

7. The method according to claim 6, wherein the inductor (12) is arranged in front of a main roll (2) and the further inductor is arranged in front of an axial roll arrangement of the ring rolling machine (1) relative to a direction of rotation of the rolling product (5).

8. The method according to claim 1, further comprising:

guiding the inductor (12) on a support arm (11) which has three degrees of freedom.

* * * * *